United States Patent [19]

Kakehashi

[11] 4,174,651

[45] Nov. 20, 1979

[54] KEYBOARD TYPE ELECTRONIC MUSICAL INSTRUMENT

[75] Inventor: Ikutaro Kakehashi, Osaka, Japan

[73] Assignee: Roland Corporation, Osaka, Japan

[21] Appl. No.: 847,146

[22] Filed: Oct. 31, 1977

[30] Foreign Application Priority Data

Oct. 29, 1976 [JP] Japan ..... 51-146515[U]

[51] Int. Cl.[2] ..... G10H 3/00

[52] U.S. Cl. ..... 84/1.11; 84/1.21; 84/1.19; 84/DIG. 23

[58] Field of Search ..... 84/1.11, 1.12, 1.19, 84/1.21, 1.22, DIG. 23

[56] References Cited

U.S. PATENT DOCUMENTS 3,902,396 9/1975 Hiyoshi ..... 84/1.22

*Primary Examiner*—Gene Z. Rubinson
*Assistant Examiner*—Leonard W. Pojunas, Jr.
*Attorney, Agent, or Firm*—Marshall & Yeasting

[57] ABSTRACT

A keyboard type electronic musical instrument which is provided with a keyboard having an arrangement of keys corresponding to an arrangement of letter names based on the scale of the equal temperament of 12 degrees, a sound signal generator for generating sound signals of frequencies defined for the letter names, first and second gate circuit means having gate circuits respectively supplied with the sound signals from the sound signal generator, a first mixer for mixing the outputs from the gate circuits of the first gate circuit means, a frequency multiplier circuit for frequency multiplying the output from the gate circuits of the second gate circuit means, and a second mixer for mixing the outputs from the frequency multiplier circuit and the first mixer. The sound signals supplied to the gate circuits of the second gate circuit means have higher or lower frequencies than the sound signals supplied to the corresponding gate circuits of the first gate circuit means. The frequency multiplying ratio of the frequency multiplier circuit is defined to have the value of the ratio between a frequency defined for the letter name of the natural scale corresponding to the letter name of the sound signal supplied to one of the gate circuits of the first gate circuit means and a frequency defined for the letter name of the natural scale corresponding to the letter name of the sound signal supplied to one of the gate circuits of the second gate circuit means.

1 Claim, 11 Drawing Figures

Fig.3
| C(i-1) | D(i-1) | E(i-1) | F(i-1) | G(i-1) | A(i-1) | B(i-1) | C(i) | D(i) | E(i) | F(i) | G(i) | A(i) | B(i) | C(i+1) |
|---|---|---|---|---|---|---|---|---|---|---|---|---|---|---|
| $\frac{1}{2}f$ | $\frac{9}{16}f$ | $\frac{5}{8}f$ | $\frac{2}{3}f$ | $\frac{3}{4}f$ | $\frac{5}{6}f$ | $\frac{15}{16}f$ | $f$ | $\frac{9}{8}f$ | $\frac{5}{4}f$ | $\frac{4}{3}f$ | $\frac{3}{2}f$ | $\frac{5}{3}f$ | $\frac{15}{8}f$ | $2f$ |
Fig.4
| $C_6^{\#}$ | $D_6$ | $D_6^{\#}$ | $E_6$ | $F_6$ | $F_6^{\#}$ | $G_6$ | $G_6^{\#}$ | $A_6$ | $A_6^{\#}$ | $B_6$ | $C_7$ |
|---|---|---|---|---|---|---|---|---|---|---|---|
| 1108.7 | 1174.7 | 1244.5 | 1318.5 | 1396.9 | 1480.0 | 1568.0 | 1661.2 | 1760.0 | 1864.7 | 1975.5 | 2093.0 |
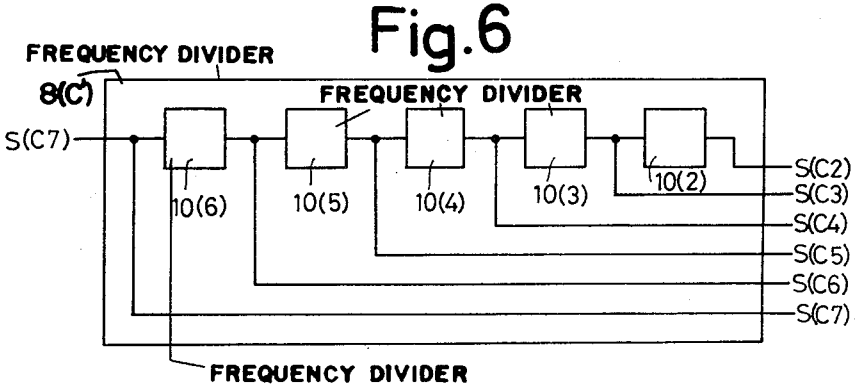
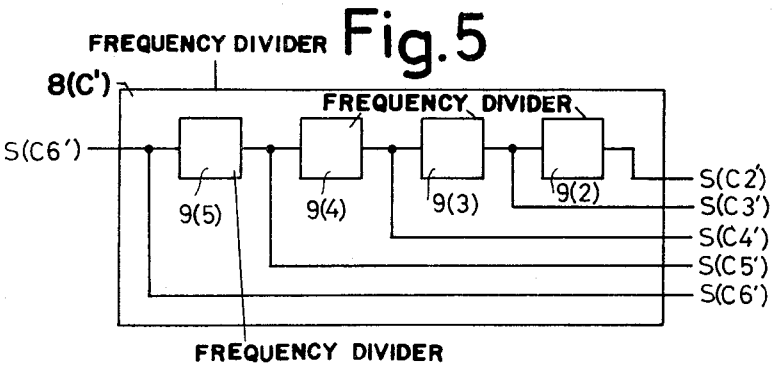

KEYBOARD TYPE ELECTRONIC MUSICAL INSTRUMENT

BACKGROUND OF THE INVENTION

1. Field of the Invention

This invention relates to improvements in a keyboard type electronic musical instrument which employs keyboards having a number of keys arranged corresponding to letter names . . . $A_{n-1}\#$, $B_{n-1}$, $C_n$, $C_n\#$, $D_n$, $D_n\#$, $E_n$, $F_n$, $F_n\#$, $G_n$, $G_n\#$, $A_n$, $A_n\#$, $B_n$, $C_{n+1}$, $C_{n+1}\#$, $D_{n+1}$, . . . (n being an integer) based on the scale of the equal temperature of 12 degrees.

2. Description of the Prior Art

This kind of keyboard type electronic musical instrument is usually adapted such that depression of a selected one of the keys of the keyboards will produce a sound signal having the frequency defined for the letter name of the selected key, at a constant level regardless of the pressure applied to the selected key. Accordingly, with such a keyboard type electronic musical instrument, in the case of playing a tune by simultaneously depressing two or more selected ones of the keys of the keyboards, that is, in the case of the so-called chord performance, the tune is played with its melody obscured.

Heretofore, a variety of proposals have been made to enable playing of a tune with a clear melody, that is, to obtain a melody emphasis effect. However, any conventional keyboard type electronic musical instruments are bulky and complicated in construction and expensive.

SUMMARY OF THE INVENTION

Accordingly, one object of this invention is to provide a novel keyboard type electronic musical instrument which is designed to produce the melody emphasis effect.

Another object of this invention is to provide a novel keyboard type electronic musical instrument which is designed to produce the melody emphasis effect without becoming bulky, complicated and expensive.

Other objects, features and advantages of this invention will become apparent from the following description taken in conjunction with the accompanying drawings.

BRIEF DESCRIPTION OF THE DRAWINGS

FIG. 3 is a diagram showing the relationship between letter names based on the natural scale and frequencies defined therefor, for explaining the embodiment of FIG. 2;

FIG. 4 is a diagram showing the relationship between some of letter names based on the scale of the equal temperament of 12 degrees and frequencies defined therefor, for explaining this invention;

FIG. 5 is a system diagram illustrating an example of one part of a frequency divider circuit shown in FIGS. 2A and 2B; and FIG. 6 is a system diagram showing an example of another part of the frequency divider circuit depicted in FIGS. 2A and 2B.

DESCRIPTION OF THE PREFERRED EMBODIMENTS

Figure 1:
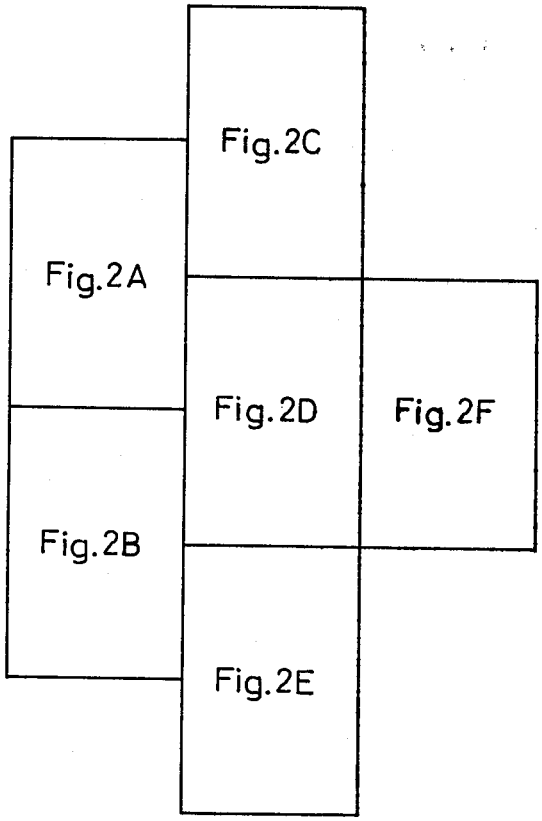
FIG. 1 is a view showing the arrangement of FIGS. 2A to 2F.
Figure 2A:
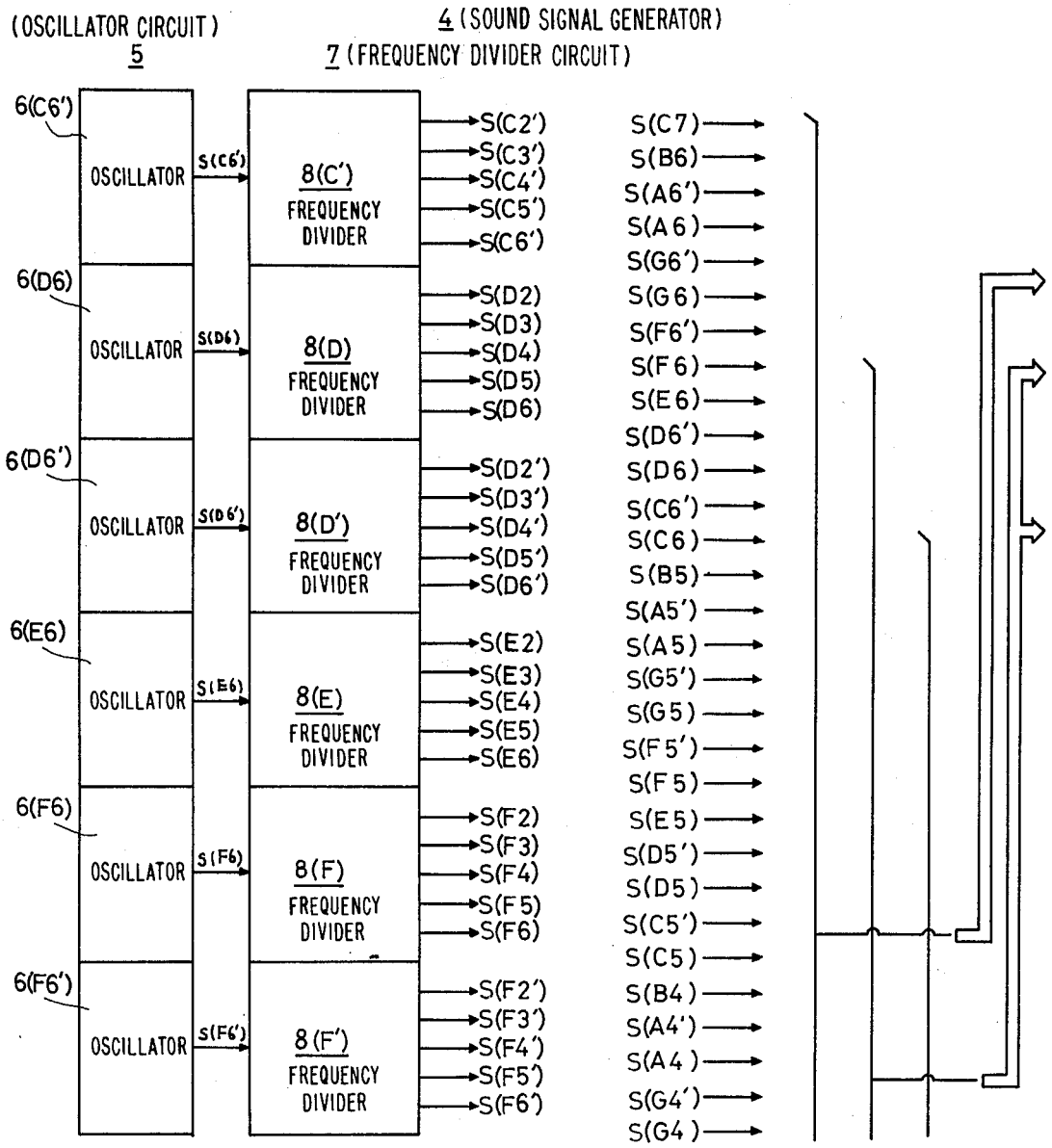
FIGS. 2A to 2F, inclusive, are system diagrams illustrating an embodiment of the keyboard type electronic musical instrument of this invention.
Figure 2B:
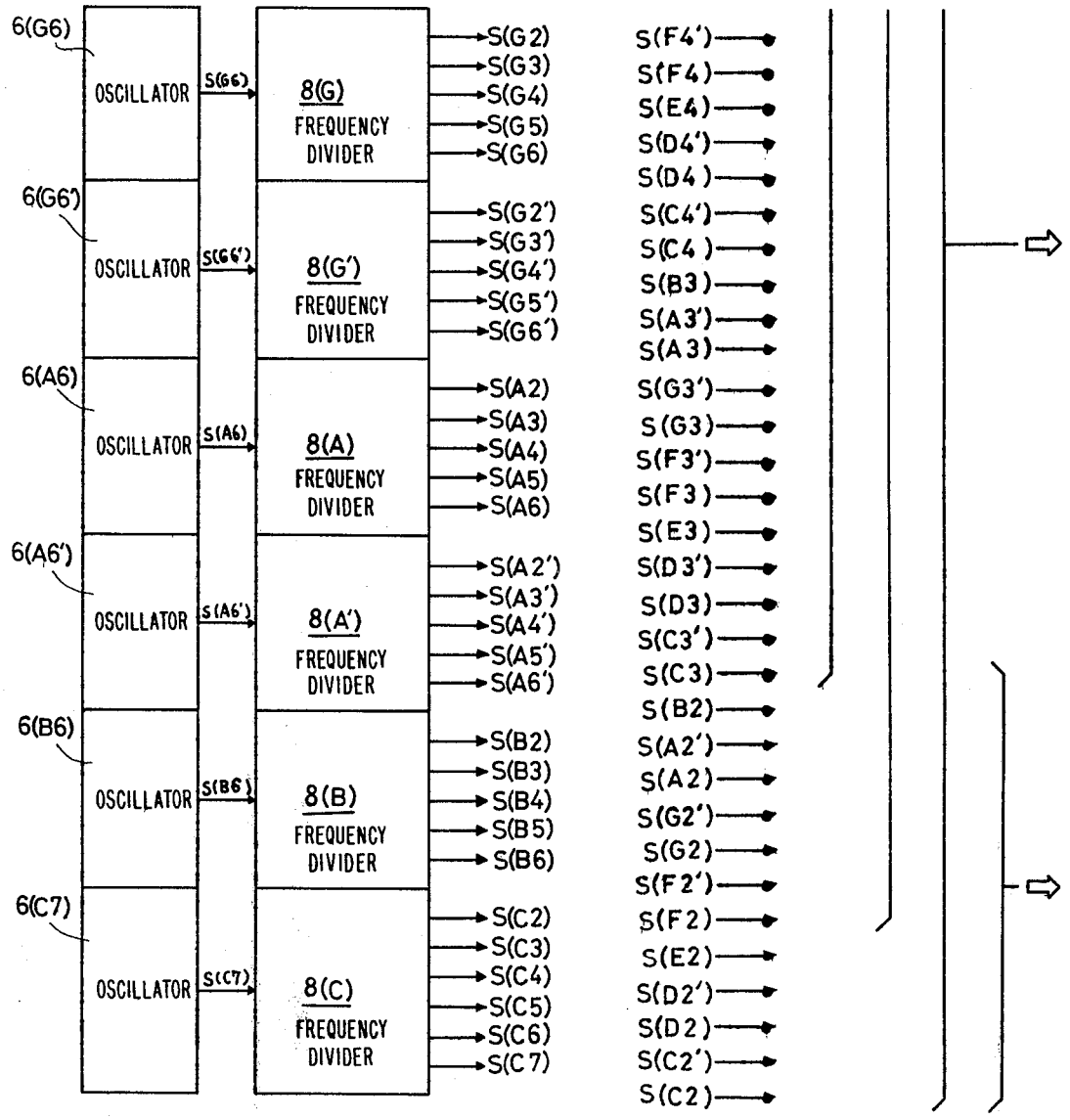
Figure 2C:
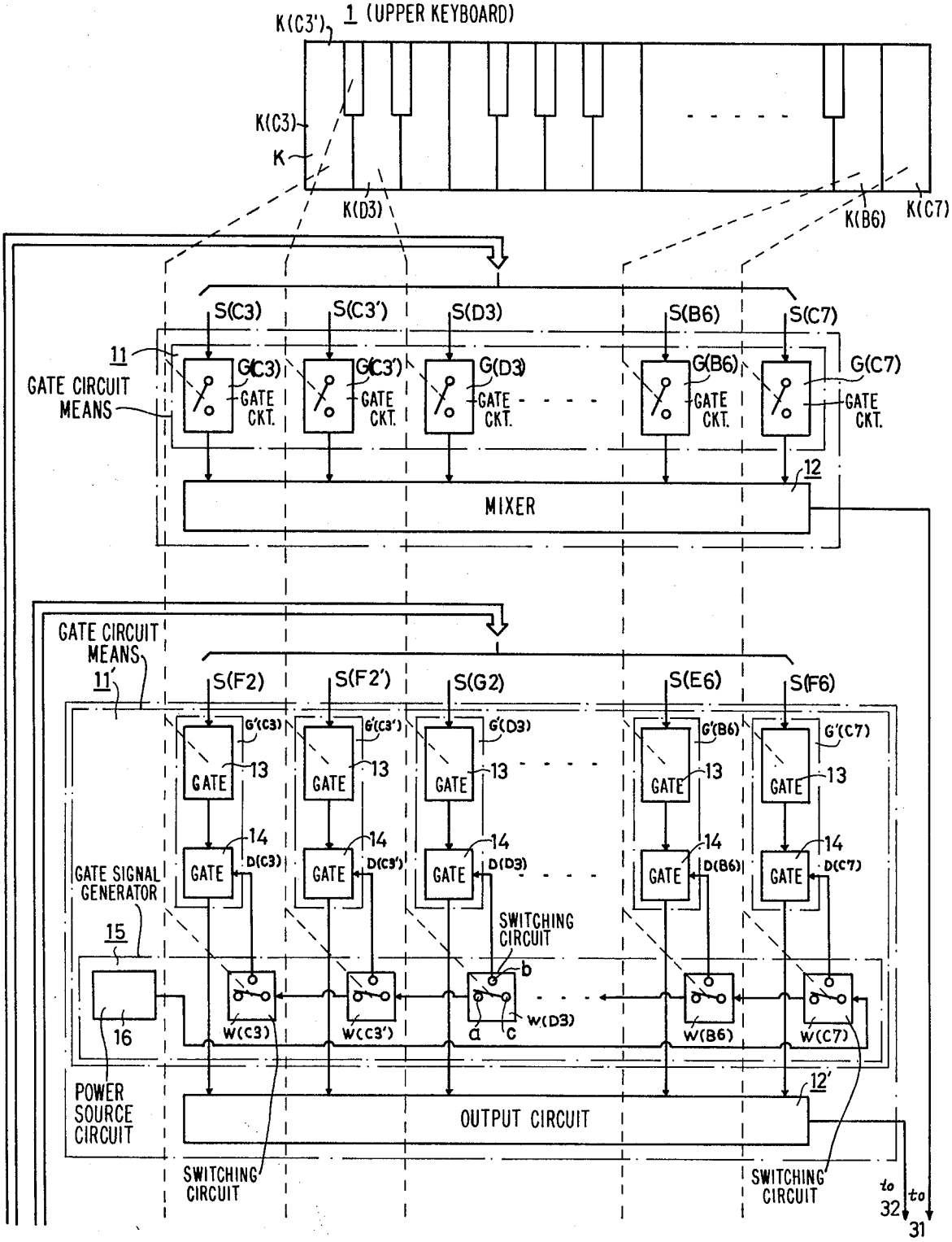
Figure 2D:
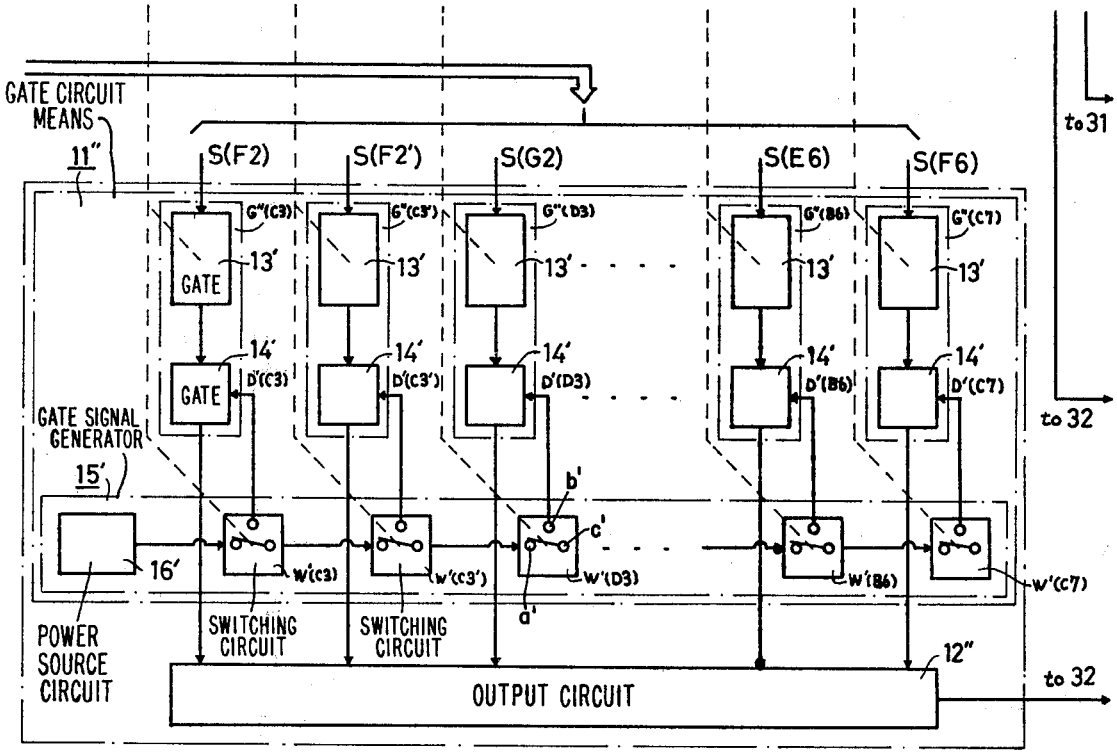
Figure 2D:
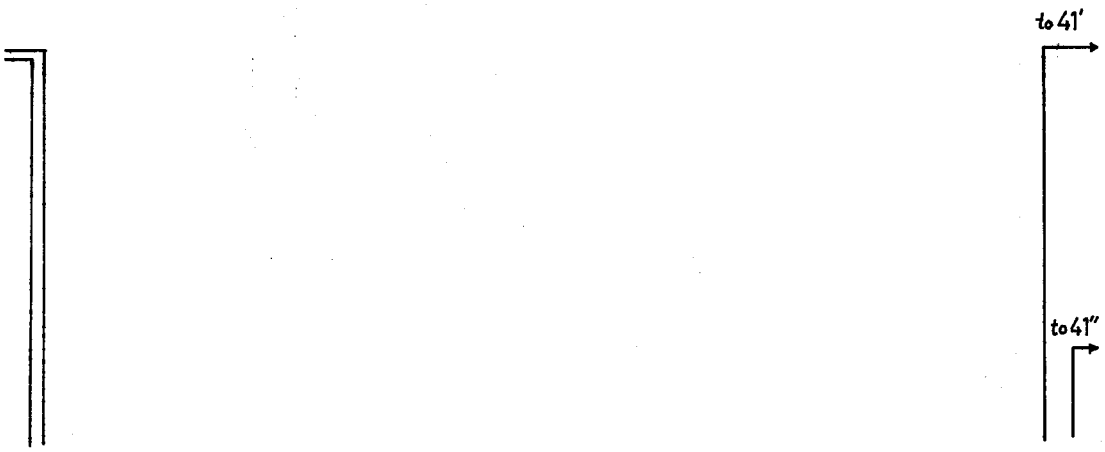
Figure 2E:
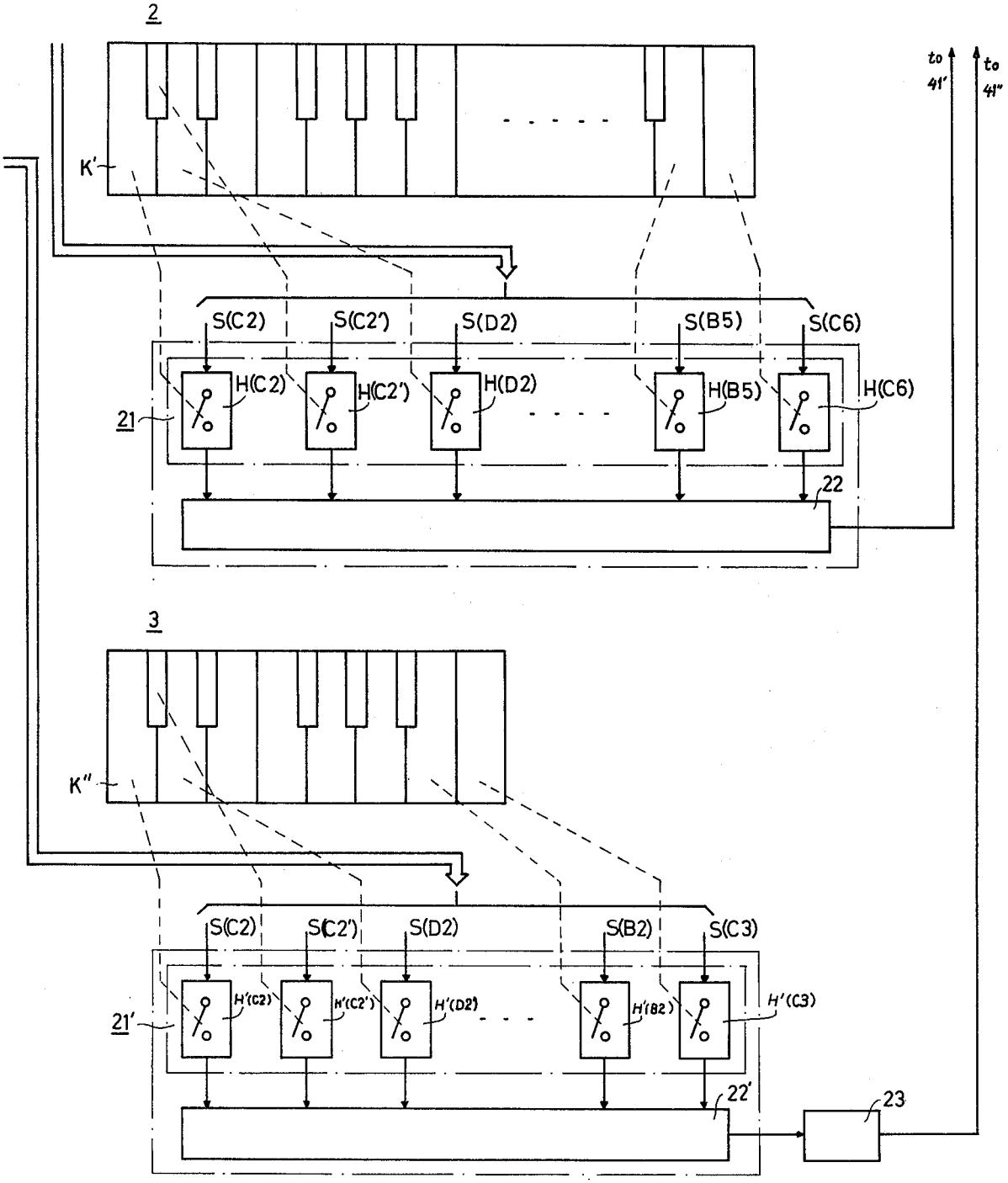

In FIG. 2C, reference numeral 1 indicates an upper keyboard, and in FIG. 2E, 2 and 3 designates a lower keyboard and a pedal keyboard, respectively.

The upper keyboard 1 has keys K(C3), K(C3'), K(D3) . . . , K(B3), K(C4), K(C4'), . . . K(B4), K(C5), . . . K(C6), . . . K(C7) arranged corresponding to the arrangement of letter names $C_3$, $C_4\#$, $D_3$, . . . $B_3$, $C_4$, $C_4\#$, . . . $B_4$, $C_5$, . . . $C_6$, . . . $C_7$ based on the scale of the equal temperament of 12 degrees. (For the sake of brevity, these letter names $C_3$, $C_3\#$, $D_3$, . . . $B_3$, $C_4$, $C_4\#$, . . . $B_4$, $C_5$, . . . $C_6$, . . . $C_7$ will hereinafter be identified as C3, C3', D3, . . . B3, C4, C4', . . . B4, C5, . . . C6, . . . C7.)

The lower keyboard 2 has keys K'(C2), K'(C2'), K'(D2), . . . K'(B2), K'(C3), K'(C3'), . . . K'(B3), K'(C4), . . . K'(C5), . . . K'(C7) arranged corresponding to the arrangement of letter names C2, C2', D2, . . . B2, C3, C3', . . . B3, C4, . . . C5, . . . C6 similarly based on the scale of the equal temperament of 12 degrees (C2, C2', D2, . . . B2 indicating the letter names $C_2$, $C_2\#$, $D_2$, . . . $B_2$).

The pedal keyboard 3 has keys K''(C2), K''(C2'), . . . K''(C3) arranged corresponding to the arrangement of letter names C2, C2', . . . C3 similarly based on the scale of the equal temperament of 12 degrees.

In FIGS. 2A and 2B, reference numeral 4 identifies a sound signal generator, which has an oscillator circuit 5.

Generally, a shown in FIG. 3, a letter name C(i+1) (i=0, 1, 2, . . .) based on the natural scale is defined to have a frequency twice a frequency f(Ci) defined for a letter name C(i) and a letter name C(i−1) is defined to have a frequency ½ of the frequency f(Ci). Similarly, letter names D(i+1), E(i+1), . . . B(i+1) are defined to have frequencies twice frequencies f(Di), f(Ei), . . . f(Bi) defined for letter names D(i), E(i), . . . B(i), respectively. Also, letter names D(i−1), E(i−1), . . . B(i−1) are defined to have frequencies ½ of the frequencies f(Di), f(Ei), . . . f(Bi), respectively. Further, frequencies f(Di), f(Ei), f(Fi), f(Gi), f(Ai) and f(Bi) are defined to have 9/8, 5/4, 4/3, 3/2, 5/3 and 15/8 of the frequency f(Ci), respectively.

On the other hand, the frequencies defined for the letter names based on the scale of the equal temperament of 12 degrees do not bear the relationships of the frequencies defined for the letter names based on the natural scale described above with regard to FIG. 3, as shown in FIG. 4 which exemplifies the frequencies defined for the letter names C6', D6, . . . B6 and C7. For example, the ratio between the frequencies f(F6) and f(C7) respectively defined for letter names F6 and C7 based on the scale of the equal temperament of 12 degrees, that is, f(F6)/f(C7), is 1396.9/2093.0, which is closed to 4/6=2/3 but is not 2/3. While, it must be noted that the ratio between the frequencies defined for letter names F(i−1) and C7 based on the natural scale corresponding to the letter names F6 and C7 based on the scale of the equal temperament of 12 degrees, respectively, is exactly 4/6=2/3.

The oscillator circuit 5 comprises oscillators 6(C6'), 6(D6), 6(D6'), . . . 6(B6) and 6(C7) which respectively produce sound signals S(C6'), S(D6), S(D6'), S(D6'), . . . S(B6) and S(C7) having frequencies f(C6'), f(D6), f(D6'), . . . f(B6) and f(C7) defined for letter names C6', D6, D6', . . . B6 and C7 based on the scale of the equal temperament of 12 degrees shown in FIG. 4.

The sound signal generator 4 has a frequency divider circuit 7. The frequency divider circuit 7 comprises frequency dividers 8(C'), 8(D), 8(D'), . . . 8(B) and 8(C) which are respectively supplied with the sound signals S(C6'), S(D6), S(D6'), . . . S(B6) and S(C7) derived from the oscillators 6(C6'), 6(D6), 6(D6') 6(B6) and 6(C7) of the oscillator circuit 5, respectively. The frequency divider 8(C') is composed of a cascade-connected circuit of four ½ frequency dividers 9(5), 9(4), 9(3) and 9(2), and is adapted to provide the sound signal S(C6') of the frequency f(C6') from the input side of the frequency divider 9(5) and sound signals S(C5'), S(C4'), S(C3') and S(C3') and S(C2') of frequencies f(C5'), f(C4'), f(C3') and f(C2') from the output sides of the frequency dividers 9(5), 9(4), 9(3) and 9(2), respectively, as shown in FIG. 5. Though not shown, the frequency dividers 8(D), 8(D'), . . . 8(B) are also similar in construction to the frequency divider 8(C') and are designed to provide the sound signals S(D6) to S(D2), S(D6') to S(D2'), . . . and S(B6) to S(B2) of the frequencies f(D6) to f(D2), f(D6') to f(D2'), . . . f(B6) to f(B2), respectively. Further, as depicted in FIG. 6, the frequency divider 8(C) comprises a cascade-connected circuit of five ½ frequency dividers 10(6), 10(5), . . . 10(2) and is arranged to provide the sound signal S(C7) of the frequency f(C7) from the input side of the frequency divider 10(6) and the sound signals S(C6), S(C5), . . . S(C2) of the frequencies f(C6), f(C5), . . . f(C2) from the output sides of the frequency dividers 10(6), 10(5), . . . 10(2), respectively.

In FIG. 2C, reference numeral 11 denotes a gate circuit means corresponding to the upper keyboard 1. The gate circuit means 11 comprises gate circuits G(C3), G(C3'), G(D3), . . . G(B4), G(C4), . . . G(C5), . . . G(C6), . . . G(B6) and G(C7) corresponding to the keys K(C3), K(C3'), K(D3), . . . K(B4), K(C4), . . . K(C5), . . . K8C6), . . . K(B6) and K(C7) of the upper keyboard 1, respectively. The gate circuits G(C3) to G(C7) are supplied with the sound signals S(C3) to S(C7) from the frequency divider circuit 7 of the sound signal generator 4, respectively, and are controlled to permit the passage therethrough of the sound signals S(C3) to S(C7) upon depression of the keys K(C3) to K(C7) of the upper keyboard 1, respectively. In practice, the gate circuits G(C3) to G(C7) are switches which are turned ON upon depression of the keys K(C3) to K(C7), respectively.

The outputs provided from the gate circuits G(C3) to G(C7) of the gate circuit means 11 are applied to a mixer 12 provided in common to the gate circuits G(C3) to G(C7).

In FIG. 2C, reference numeral 11' represents another gate circuit means corresponding to the upper keyboard 1. The gate circuit means 11' comprises gate circuits G'(C3) to G'(C7) respectively corresponding to the keys K(C3) to K(C7) of the upper keyboard 1 as is the case with the aforementioned gate circuit means 11. The gate circuits G'(C3) to G'(C7) are respectively supplied with the sound signals S(F2) to S(F6) derived from the frequency divider circuit 7 of the sound signal generator 4. The gate circuits G'(C3) to G'(C7) are each composed of, for instance, a cascade-connected circuit of a gate 13 and another gate 14 connected to the output side thereof. The gates 13 of the gate circuits G'(C3) to G'(C7) are switches which are turned ON upon depression of the keys K(C3) to K(C7) of the upper keyboard 1, respectively. The gates 14 of the gate circuits G'(C3) to G'(C7) are respectively controlled to be turned ON by gate signals D(C3) to D(C7) which are obtained from a gate signal generator 15. Th gate signal generator 15 has, for example, switching circuits W(C3) to W(C7) corresponding to the keys K(C3) to K(C7) of the upper keyboard 1, respectively. The switching circuits W(C3) to W(C7) are each composed of a normally closed fixed contact a and a normally open fixed contact b and a movable contact c. The movable contact c of the switching circuit W(C7) is connected to a DC power source circuit 16 and the contacts a of the switching circuits W(C7), W(B6), . . . W(C3) are connected to the contacts c of the switching circuits W(B6), W(A6'), . . . W(C3), respectively. The switching circuits W(C3) to W(C7) are adapted such that their movable contacts c are changed over to the contacts b upon depression of the keys K(C3) to K(C7) of the upper keyboard 1, respectively. For instance, when the keys K(E6), K(G6) and K(C6) are simultaneously depressed, only the contact b of the switching circuit W(C7) is connected to the DC power source circuit 16, so that a DC voltage is provided from the contact b, which voltage is obtained as the gate signal D(C7) for the gate 14 of the gate circuit G(C7).

The outputs from the gates 14 of the gate circuits G'(C3) to G'(C7) of the gate circuit means 11' are supplied to an output circuit 12' provided in common to the gate circuits G'(C3) to G'(C7).

In FIG. 2D, reference numeral 11" indicates still another gate circuit means corresponding to the upper keyboard 1. The gate circuit means 11" comprises gate circuits G"(C3) to G"(C7), each composed of a cascade-connected circuit of a gate 13' and another gate 14' connected to the output side thereof, and supplied with the sound signals S(F2) to S(F6) from the frequency divider circuit 7 of the sound signal generator 4, as is the case with the aforesaid gate circuit means 11'. The gates 13' of the gate circuits G"(C3) to G"(C7) are switches which are turned ON by the depression of the keys (KC3) to K(C7), respectively. The gates 14' of the gate circuits G"(C3) to G"(C7) are respectively controlled to be turned ON by gate signals D'(C3) to D'(C7) derived from a gate signal generator 15'. The gate signal generator 15' has, for example, switching circuits W'(C3) to W'(C7) respectively corresponding to the keys K(C3) to K(C7) of the upper keyboard 1, as is the case with the aforementioned gate signal generator 15. A movable contact c' of the switching circuit W'(C3) is connected to a DC power source circuit 16' and normally closed fixed contacts a' of the switching circuits W'(C3), . . . W'(B6) are connected to the movable contacts c' of the switching circuits W'(C3), . . . W'(C7), respectively. The movable contacts c' of the switching circuits W'(C3) to W'(C7) are adapted to be turned down to normally open fixed contacts b' by the depression of the keys K(C3) to K(C7) of the upper keyboard 1, respectively. Accordingly, for instance, when the keys K(E6), K(G6) and K(C7) are simultaneously depressed, only the normally open fixed contact b' of the switching circuit W'(E6) is connected to the DC power source circuit 16', so that a DC voltage is provided from the b', which voltage is obtained as the gate signal D'(E6) for the gate 14' of the gate circuit G"(E6).

The outputs from the gates 14' of the gate circuits G"(C3) to G"(C7) of the gate circuit means 11" are supplied to an output circuit 12 provided in common to the gate circuits G"(C3) to G"(C7).

In FIG. 2E, reference numeral 21 designates a gate circuit means corresponding to the lower keyboard 2. The gate circuit means 21 comprises gate circuits H(C2)

to H(C6) respectively corresponding to the keys K'(C2) to K'(C6) of the lower keyboard 2 as is the case with the aforesaid gate circuit means 11. The gate circuits H(C2) to H(C6) are respectively supplied with the sound signals S(C2) to S(C6) from the frequency divider circuit 7 of the sound signal generator 4, and are controlled to permit the passage therethrough of the sound signals S(C2) to S(C7) upon depression of the keys K'(C2) to K'(C6) of the lower keyboard 2, respectively.

The outputs from the gate circuits H(C2) to H(C6) of the gate circuit means 21 are fed to a mixer 22 provided in common to the gate circuits H(C2) to H(C7).

In FIG. 2E, reference numeral 21' indicates still another gate circuit means corresponding to the pedal keyboard 3. The gate circuit means 21' comprises gate circuits H'(C2) to H'(C3), each composed of a cascade-connected circuit of a gate 13'' and another gate 14'' connected to the output side thereof, and supplied with the sound signals S(C2) to S(C3) from the frequency divider circuit 7 of the sound signal generator 4, as is the case with the aforesaid gate circuit means 11''. The gates 13'' of the gate circuits H'(C2) to H'(C3) are switches which are turned ON by the depression of the keys K''(C2) to L''(C3), respectively. The gates 14'' of the gate circuits H'(C2) to H'(C3) are respectively controlled to be turned ON by gate signals D''(C2) to D''(C3) derived from a gate signal generator 15''. The gate signal generator 15'' has, for example, switching circuits W''(C2) to W''(C3) respectively corresponding to the keys K''(C2) to K''(C3) of the pedal keyboard 3, as is the case with the aforementioned gate signal generator 15''. A movable contact c'' of the switching circuit W''(C2) is connected to a DC power source circuit 16'' and normally closed fixed contacts a'' of the switching circuits W''(C2), . . . W''(B2) are connected to the movable contacts c'' of the switching circuits W''(C2), . . . W''(C3), respectively. The movable contacts e'' of the switching circuits W''(C2) to W''(C3) are adapted to be turned down to normally open fixed contacts b'' by the depression of the keys K''(C2) to K''(C3) of the pedal keyboard 3, respectively. Accordingly, for instance, when the keys K''(C2) and K''(C2') are simultaneously depressed, only the normally open fixed contact b'' of the switching circuit W''(C2) is connected to the DC power source circuit 16'', so that a DC voltage is provided from the contact b'', which voltage is obtained as the gate signal D''(C2) for the gate 14'' of the gate circuit H'(C2).

The outputs from the gate circuits H'(C2) to H'(C3) of the gate circuit means 21' are supplied to an output circuit 22' provided in common to the gate circuits H'(C2) to H'(C3). The output from the output circuit 22' is applied to a ½ frequency divider 23 to provide an output that the output circuit output is frequency divided down to ½.

Figure 2F:
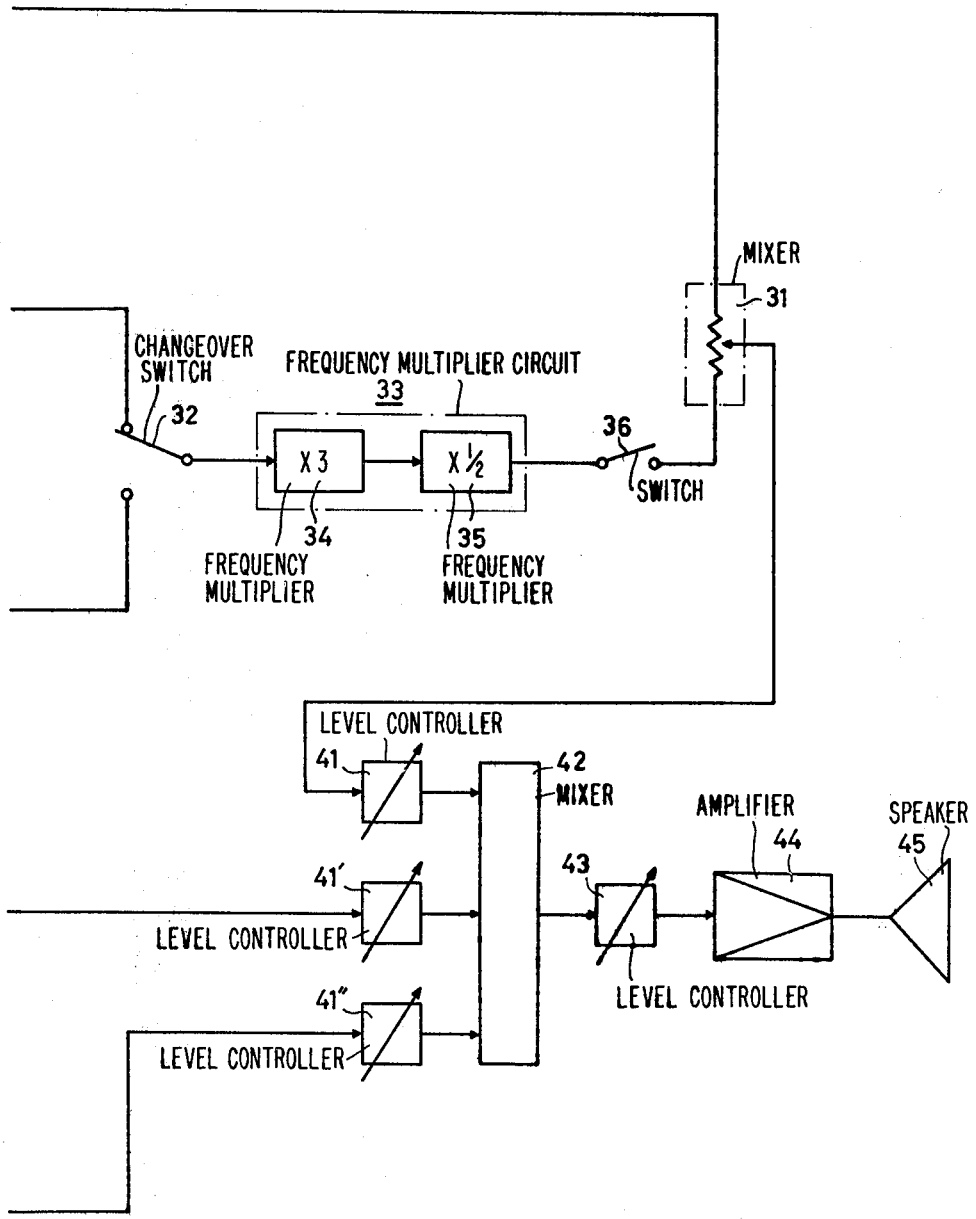

The output from the aforesaid mixer 12 is applied to one input of a mixer 31, as shown in FIG. 2F.

The outputs from the output circuits 12' and 12'' are selected by a change-over switch 32 and applied to a frequency multiplier circuit 33. In this instance, the frequency multiplying ratio of the frequency multiplier circuit 33 is defined as follows. That is, a sound signal (generally identified as $S_M$), which is supplied from the frequency divider circuit 7 of the sound signal generator 4 to the gate circuit (generally identified as $G_M$) of the gate circuit means 11 corresponding to one of the keys (generally identified as $K_M$) of the uppr keyboard 1 which corresponds to one of the letter names based on the scale of the equal temperament of 12 degrees corresponding to one of the letter names based on the natural scale, and sound signals (generally identified as $S_M'$), which are respectively supplied from the frequency divider circuit 7 of the sound signal generator 4 to the gate circuits (generally identified as $G_i'$ and $G_i''$, respectively), of the gate circuit means 11' and 11'' corresponding to the key $k_M$, have a relationship of the "fifth". Accordingly, the value of the ratio between the frequency defined for the letter name based on the natural scale corresponding to the letter name based on the scale of the equal temperament of 12 degrees corresponding to the sound signal $S_M$ and the frequency defined for the letter name based on the natural scale corresponding to the letter name based on the scale of the equal temperament of 12 degrees corresponding to the sound signal $S_M'$, is applied to the frequency multiplying ratio of the frequency multiplier circuit 33. For example, if the abovesaid key $K_M$ is the key K(C7), the sound signals $S_M$ and $S_M'$ are the sound signals S(C7) and S(F6), respectively. Further, the letter names based on the scale of the equal temperament of 12 degrees to which the sound signals S(C7) and S(F6) correspond, are C7 and F6, respectively. On the other hand, the letter names based on the scale of the equal temperament of 12 degrees corresponding to these letter names C7 and F6, are Ci and F(i-1) and the frequencies defined for these letter names Ci and F(i-1) are f and (4/6)f, respectively. Accordingly, the frequency multiplying ratio of the frequency multiplier circuit 33 is defined such that $1/(4/6)=6/4=3/2$.

In practice, the frequency multiplier circuit 33 comprises a cascade-connected circuit of a frequency multiplier 34 for multiplying three times the frequency of the input signal and another frequency multiplier 35 for multiplying ½ times the input signal frequency.

The output from the frequency multiplier circuit 33 is supplied to the other input of the aforesaid mixer 31 through a switch 36. In this case, the mixer 31 is adapted to be capable of controlling the level ratio between the output from the gate circuit means 11 and the output from the frequency multiplier circuit 33.

The output from the mixer 31 is applied to a mixer 42 through a level controller 41 and the mixer 42 is supplied with the outputs from the output circuit 22 and the ½ frequency divider 23 through level controllers 41' and 41'', respectively.

The output from the mixer 42 is applied to a speaker 45 through a level controller 43 and an amplifier 44.

The above is the construction of an embodiment of this invention. With such a construction, the following operations are obtained.

Now, consider the following cases.

Case Y1: The switch 36 is OFF.

Case Y2: The switch 36 is ON.

Case Y3: The change-over switch 32 selects the output circuit 12'.

Case Y4: The change-over switch 32 selects the output circuit 12''.

Case Y5: Q keys (Q being an integer larger than unity) arbitrarily selected from the keys K(C3) to K(C7) of the upper keyboard 1 are simultaneously depressed. (The Q keys are such that the keys corresponding to the letter names defined in order of frequency from the lower to the higher one are sequentially arranged, and these keys are identified $K_1$, $K_2$, . . . $K_Q$, respectively.)

Case Y6: Q' keys (Q' being an integer larger than unity) arbitrarily selected from the keys K'(C2) to K'(C6) of the lower keyboard 2 are simultaneously depressed. (The Q' keys are similarly identified $K_1'$, $K_2'$, . . . $K_Q'$, respectively.)

Case Y7: One key (identified as $K''_p$) arbitrarily selected from the keys K''(C2) to K''(C3) of the pedal keyboard 3 are simultaneously depressed.

Then, in the following case, the following modes of operation are obtained.

Mode Z1: The case of combination of cases Y1 and Y5

If the gate circuits of the gate circuit means 11 corresponding to the keys $K_1$, $K_2$, . . . $K_Q$ are taken as $G_1$, $G_2$, . . . $G_Q$ and if the sound signals supplied to the gate circuits $G_1$, $G_2$, . . . $G_Q$ from the frequency divider circuit 7 of the sound signal generator 4 are taken as $S_1$, $S_2$, . . . $S_Q$, respectively, the sound signals $S_1$, $S_2$, . . . $S_Q$ are applied to the mixer 12 through the gate circuits $G_1$, $G_2$, . . . $G_Q$ of the gate circuit means 11, respectively. The mixer 12 mixes together the sound signals $S_1$, $S_2$, . . . $S_Q$ to provide a composite signal ($S_1+S_2+ \ldots S_Q$), which is supplied to the speaker 45 through the mixer 31, the level controller 41, the mixer 42, the level controller 43 and the amplifier 44, producing a mixed sound of the individual sounds based on the sound signals $S_1$, $S_2$, . . . $S_Q$, respectively. For instance, assuming the Q=3 and that the keys $K_1$, $K_2$ and $K_3$ are the keys K(E6), K(F6) and K(C7), respectively, a mixed sound of the individual sounds corresponding to the letter names E6, F6 and C7, is produced from the speaker 45.

Mode Z2: The case of combination of cases Y1 and Y6

Letting the gate circuits of the gate circuit means 21 corresponding to the keys $K_1'$, $K_2'$, . . . $K_Q'$, be represented by $H_1$, $H_2$, . . . $H_Q$, respectively, and letting the sound signals supplied from the sound signal generator 4 to the gate circuits $H_1$, $H_2$, . . . $H_Q$, be represented by $S_1'$, $S_2'$, . . . $S_Q'$, respectively, the sound signals $S_1'$, $S_2'$, . . . $S_Q'$, are applied to the mixer 22 through the gate circuits $H_1$, $H_2$, . . . $H_Q$, respectively. The mixer 22 mixes together the sound signals $S_1'$, $S_2'$, . . . $S_Q'$, to provide a composite signal ($S_1'+S_2'+ \ldots S_Q'$), which is supplied to the speaker 45 through the level controller 41', the mixer 42, the level controller 43 and the amplifier 44, producing a mixed sound of the individual sounds based on the sound signals $S_1'$, $S_2'$, . . . $S_Q'$.

Mode Z3: The case of combination of cases Y1 and Y7

If the gate circuit of the gate circuit means 21' corresponding to the key $K''_p$ is taken as $H'_p$, and if the sound signal supplied to the above gate circuit $H'_p$ is taken as $S''_p$, the sound signal $S''_p$ is applied to the output circuit 22' via the gate circuit $H'_p$, then the sound signal $S''_p$ is applied via the output circuit 22' to the ½ frequency divider 23 to derive therefrom a sound signal lower than the sound signal $S''_p$ by one octave. The sound signal thus obtained is supplied to the speaker 45 through the level controller 41'', the mixer 42, the level controller 43 and the amplifier 44, producing a sound lower than the sound signal $S''_p$ by one octave. Accordingly, even if the keys $K''_p$ and $K''_{p+1}$ are simultaneously depressed by mistake, the sound signal $S''_{p+1}$ which is supplied to the gate circuit $H'_{p+1}$ is not supplied to the frequency divider 23 via the output circuit 22' because the gate signal $D''_{p+1}$ is not supplied to the gate 14'' of the gate circuit $H'_{p+1}$. Thus, even if the keys $K''_p$ and $K''_{p+1}$ are simultaneously depressed, only the sound lower than the sound signal $S''_p$ by one octave is obtained from the speaker 45.

Mode Z4: The case of combination of cases Y2, Y3 and Y5

The case Y2 is not affected by the mode Z1 because the position of the switch 36 is independent of the mode Z1, so that the sound signal ($S_1+S_2+ \ldots S_Q$) composed of the sound signals $S_1$, $S_2$, . . . $S_Q$ is supplied to the mixer 31, as is evident from the foregoing description given in connection with the mode Z1.

On the other hand, if the gate circuits of the gate circuit means 11' corresponding to the keys $K_1$, $K_2$, . . . $K_Q$ are taken as $G_1'$, $G_2'$, . . . $G_Q'$, respectively, and if the sound signals supplied thereto from the sound signal generator 4 are taken as $S'_{1\text{-}5}$, $S'_{2\text{-}5}$, . . . $S'_{Q\text{-}5}$, respectively, only the sound signal $S'_{Q\text{-}5}$ is applied to the frequency multiplier circuit 33 through the gate circuit $G_Q'$ the output circuit 12' and the change-over switch 32. As a result of this, the frequency multiplier circuit 33 provides such a sound signal (identified as $S_Q^*$) that the frequency of the sound signal $S'_{Q\text{-}5}$ is multiplied by the multiplying ratio of the frequency multiplier circuit 33. The sound signal $S_Q^*$ is supplied to the mixer 31, in which it is mixed with the sound signal ($S_1+S_2+ \ldots S_Q$) to provide a composite sound signal ($S_1+S_2+ \ldots S_Q+S_Q^*$), which is applied to the speaker 45 through the level controller 41, the mixer 42, the level controller 43 and the amplifier 44. By the way, since the sound signal $S_Q^*$ is such a sound signal that the sound signal $S'_{Q\text{-}5}$ is frequency multiplied by the frequency multiplying ratio of the frequency multiplier circuit 33 determined as described previously, the sound signal $S_Q^*$ has a frequency (identified as $f_Q^*$) close to the frequency (identified as $f_Q$) of the sound signal $S_Q$. For example, assuming that Q=3 and that the keys $K_1$, $K_2$ and $K_3$ are those K(E6), K(F6) and K(C7) and that the frequency multiplying ratio of the frequency multiplier circuit 33 is 3/2 as mentioned previously, the frequency $f_Q$ of the sound signal $S_Q$ is 2093.0 Hz, as shown in FIG. 4, since the sound signal $S_Q$ is this case is the sound signal S(C7). The frequency of the sound signal $S_{Q\text{-}5}$ is 1396.9 Hz, as depicted in FIG. 4, since the sound signal $S_{Q\text{-}5}$ in this case is the sound signal S(F6). Accordingly, the frequency of the sound signal $S_Q^*$ is $1396.9\times(3/2)=2095.35$ Hz and the sound signal $S_Q^*$ has a very slight frequency difference of $2095.35-2093.0=2.35$ Hz with the sound signal $S_Q$. Consequently, it might be said that the sound signal $S_Q^*$ is the sound signal corresponding to the same letter name as that to which the sound signal $S_Q$ corresponds.

As a result of this, the speaker 45 produces a mixed sound which is similar to that composed of the individual sounds based on the sound signals $S_1$, $S_2$, . . . $S_Q$ but in which the sound of the sound signal $S_Q$ is emphasized. For example, the accord of the sounds corresponding to the letter names E6, F6 and C7 is obtained as such a sound that the sound corresponding to the letter name C7 is emphasized.

Accordingly, in the case of continuously playing a tune in the mode of the case Y5 without fixing the keys depressed, that is, in the case of the chord performance, if the key $K_Q$ is that depressed to represent the melody of the tune being played, a sound having the melody emphasizing effect can be obtained.

Mode Z5: The case of combination of cases Y2, Y4 and Y5

The case Y2 is not affected by the mode Z1 because the position of the switch 36 is independent of the mode Z1, so that the sound signal ($S_1+S_2+ \ldots S_Q$) composed of the sound signals $S_1$, $S_2$, . . . $S_Q$ is supplied to the mixer 31, as is evident from the foregoing description given in connection with the mode Z1.

On the other hand, if the gate circuits of the gate circuit means 11'' corresponding to the keys $K_1$, $K_2$, . . . $K_Q$ are taken as $G_1''$, $G_2''$, . . . $G_Q''$ respectively, and if the sound signals supplied thereto from the sound signal generator 4 are taken as $S''_{1\text{-}5}$, $S''_{2\text{-}5}$, . . . $S''_{1\text{-}5}$, respectively, only the sound signal $S''_{1\text{-}5}$ is applied to the frequency multiplier circuit 33 through the gate circuit $G_1'$, the output circuit 12'' and the change-over switch 32. As a result of this, the frequency multiplier circuit 33 provides such a sound signal (identified as $S_1$*) that the frequency of the sound signal $S''_{1\text{-}5}$ is multiplied by the multiplying ratio of the frequency multiplier circuit 33. The sound signal $S_1$* is supplied to the mixer 31, in which it is mixed with the sound signal ($S_1+S_2+ \ldots S_Q$) to provide a composite sound signal ($S_1+S_2+ \ldots S_Q+S_1$*), which is applied to the speaker 45 through the level controller 41, the mixer 42, the level controller 43 and the amplifier 44. By the way, since the sound signal $S_1$* is such a sound signal tha the sound signal $S''_{1\text{-}5}$ is frequency multiplied by the frequency multiplying ratio of the frequency multiplier circuit 33 determined as described previously, the sound signal $S_1$* has a frequency (identified as $f_1$*) close to the frequency (identified as $f_1$) of the sound signal $S_1$. For example, assuming that Q=2 and that the keys $K_1$ and $K_2$ are those K(G6) and K(C7) and that the frequency multiplying ratio of the frequency multiplier circuit 33 is 3/2 as mentioned previously, the frequency $f_1$ of the sound signal $S_1$ is 1568.0 Hz, as shown in FIG. 4, since the sound signal $S_1$ in this case is the sound signal S(G6). The frequency of the sound signal $S_{1\text{-}5}$ is $2093.0\times\frac{1}{2}=1046.5$ Hz, since the sound signal $S_{1\text{-}5}$ in this case is the sound signal S(C6). Accordingly, the frequency of the sound signal $S_1$* is $1046.5\times3/2=1569.75$ Hz and the sound signal $S_1$* has a very slight frequency difference of $1569.75-1568.0=1.75$ Hz with the sound signal $S_1$. Consequently, it might be said that the sound signal $S_1$* is the sound signal corresponding to the same letter name as that to which the sound signal $S_1$ corresponds.

As a result of this, the speaker 45 produces a mixed sound which is similar to that composed of the individual sounds based on the sound signals $S_1$, $S_2$, . . . $S_Q$ but in which the sound of the sound signal $S_1$ is emphasized. For example, the accord of the sounds corresponding to the letter names G6 and C7 is obtained as such a sound that the sound corresponding to the letter name G6 is emphasized.

Accordingly, in the case of continuously playing a tune in the mode of the case Y5 without fixing the keys depressed, that is, in the case of a chord performance, if the key $K_1$ is that depressed to represent the melody of the tune being played, a sound having the melody emphasizing effect can be obtained.

As is evident from the foregoing, with the construction of the above embodiment of this invention, it is possible to play a tune with the melody emphasizing effect. And the construction having such an advantage is neither bulky nor complicated nor expensive. That is, in the case of the abovesaid construction of this invention, the arrangement except the system of the gate circuit means 11' or 11''—the switch 32—the frequency multiplier circuit 33—the switch 36—the mixer 31, that is, except only the system associated with the gate circuit means 11 or 11', is usually employed in the conventional keyboard type electronic musical instruments. Accordingly, only by applying the abovesaid system related to the gate circuit means 11 or 11' to the prior art keyboard type electronic musical instrument, the abovesaid effect of this invention can be obtained and the system related to the gate circuit means 11 or 11' is very simple, so that the construction producing the abovesaid effect do not become bulky, complicated and expensive.

The foregoing embodiment should be construed as being illustrative of this invention and many modifications and variations may be effected. For example, instead of supplying the sound signals S(F2) to S(F6) from the sound signal generator 4 to the gate circuits G'(C3) to G'(C7) of the gate circuit means 11 and the gate circuits G''(C3) to G''(C7) of the gate circuit means 11', respectively, it is also possible to supply a selected one of sets of sound signals S(D2), to S(D6), S(E2) to S(E6), S(G2) to S(G6), S(A2) to S(A6) and S(B2) to S(B6). In this case, for example, if the sound signals S(D2) to S(D6) are used, the frequency multiplying ratio of the frequency multiplier 33 is selected to be 16/9 utilizing the frequency relationship between the natural scales D(i−1) and C(i). In the case of using the sound signals S(E2) to S(E6), the frequency multiplying ratio is selected to be 8/5 utilizing the frequency relationship between the natural scales E(i−1) and C(i). Further, in the cases of using the sound signals S(G2) to S(G6), S(A2) to S(A6) and S(B2) to S(B6), the frequency multiplying ratio is selected to be 4/3, 6/5 and 16/15, respectively, utilizing the frequency relationships between the natural scales G(i−1) and C(i), between A(i−1) and C(i) and between B(i−1) and C(i), respectively.

In the foregoing, the gate circuit means corresponding to that 11' or 11'' for the upper keyboard 1 are not provided for the lower keyboards 2 but such gate circuit means may also be provided, by which the melody emphasizing effect can be obtained in the performance of a tune using the lower keyboards 2, as is the case with the performance of a tune using the upper keyboard 1. In this case, however, the gate circuits of the gate circuit means provided for the lower keyboard 2 is supplied with sound signals of higher frequencies than the sound signals supplied to the gate circuits of the corresponding gate circuit means 21. The reason is that the gate circuit means 21 uses a sound signal of the lowest frequency among the sound signals derived from the sound signal generator 4. Let it be assumed, for example, that the sound signals S(C2) to S(C6) are respectively supplied to the gate circuits H(2) to H(6) of the gate circuit means 21 for the lower keyboard 2, as described above. In this case, if the gate circuits of the gate circuit means corresponding to that 21 for the lower keyboard 2 are taken as H'(2) to H'(6) and H''(2) to H''(6), these gate circuits H'(2) to H'(6) and H''(2) to H''(6) are respectively supplied with the sound signals of a selected one of the sets of sound signals S(D2) to S(D6), S(E2) to S(E6), S(F2) to S(F6), S(G2) to S(G6), S(A2) to S(A6) and S(B2) to S(B6). In the cases of using the sound signals S(D2) to S(D6), S(E2) to S(E6), S(F2) to S(F6), S(G2) to S(G6), S(A2) to S(A6) and S(B2) to S(B6), respectively, the frequency multiplying ratio of the frequency multiplier 33 is selected to be 8/9, 4/5, 3/4, 3/2, 3/5 and 8/15, respectively, utilizing the frequency relationships between the natural scales D(i) and C(i), between E(i) and C(i), between F(i) and C(i), between G(i) and C(i), between A(i) and C(i) and between B(i) and C(i), respectively.

It will be apparent that many modifications and variations may be effected without departing from the scope of novel concepts of this invention.

What is claimed is:

1. A keyboard type electronic musical instrument comprising:

a keyboard having an arrangement of keys . . . $K_{-2}$, $K_{-1}$, $K_0$, $K_{+1}$, $K_{+2}$, . . . corresponding to an arrangement of letter names . . . $H_{-2}$, $H_{-1}$, $H_0$, $H_{+1}$, $H_{+2}$, . . . , where $H_0$ is one of letter names . . . $A_{n+1}\#$, $B_{n-1}$, $C_n$, $C_n\#$, $D_n$, $D_n\#$, $E_n$, $F_n$, $F_n\#$, $G_n$, $G_n\#$, $A_n$, $A_n\#$, $B_n$, $C_{n+1}$, $C_{n+1}\#$, $D_{n+1}$, . . . based on the scale of the equal temperament of 12 degrees (n being an integer), $H_{+1}$, $H_{+2}$, . . . are letter names defined for frequencies higher than that for the letter name $H_0$ and sequentially arranged in an increasing order of frequency and $H_{-1}$, $H_{-2}$, . . . are letter names defined for frequencies lower than that for the letter name $H_0$ and sequentially arranged in a decreasing order of frequency;

a sound signal generator for generating sound signals . . . $S_{-2}$, $S_{-1}$, $S_0$, $S_{+1}$, $S_{+2}$, . . . having frequencies $F_{-2}$, $f_{-1}$, $f_0$, $f_{+1}$, $f_{+2}$, . . . defined for the letter names . . . $H_{-2}$, $H_{-1}$, $H_0$, $H_{+1}$, $H_{+2}$, . . . , respectively;

first gate circuit means including gate circuits . . . $G_{-2}$, $G_{-1}$, $G_0$, $G_{+1}$, $G_{+2}$, . . . respectively corresponding to the keys . . . $K_{-2}$, $K_{-1}$, $K_0$, $K_{+1}$, $K_{+2}$, . . . of the keyboard;

a first mixer for mixing the outputs from the gate circuits . . . $G_{-2}$, $G_{-1}$, $G_0$, $G_{+1}$, $G_{+2}$, . . . of the first gate circuit means;

second gate circuit means including gate circuits . . . $G'_{-2}$, $G'_{-1}$, $G'_0$, $G'_{+1}$, $G'_{+2}$, . . . respectively corresponding to the keys . . . $K_{-2}$, $K_{-1}$, $K_0$, $K_{+1}$, $K_{+2}$, . . . of the keyboard;

a frequency multiplier for frequency multiplying the outputs from the gate circuits . . . $G'_{-2}$, $G'_{-1}$, $G'_0$, $G'_{+1}$, $G'_{+2}$, . . . of the second gate circuit means;

a second mixer for mixing the outputs from the first mixer and the frequency multiplier;

wherein the gate circuits . . . $G_{-2}$, $G_{-1}$, $G_0$, $G_{+1}$, $G_{+2}$, . . . of the first gate circuit means are respectively supplied with the sound signals . . . $S_{-2}$, $S_{-1}$, $S_0$, $S_{+1}$, $S_{+2}$, . . . from the sound signal generator and are controlled to pass therethrough the sound signals . . . $S_{-2}$, $S_{-1}$, $S_0$, $S_{+1}$, $S_{+2}$, . . . upon depression of the keys . . . $K_{-2}$, $K_{-1}$, $K_0$, $K_{+1}$, $K_{+2}$, . . . of the keyboard;

wherein the gate circuits . . . $G'_{-2}$, $G'_{-1}$, $G'_0$, $G'_{+1}$, $G'_{+2}$, . . . of the second gate circuit means are respectively supplied with sound signals . . . $S_{-2+p}$, $S_{-1+p}$, $S_{O+p}$, $S_{+1+p}$, $S_{+2+p}$, . . . (p being a positive or negative integer larger than unity) and are controlled so that when Q (an integer larger than unity) selected ones of the keys . . . $K_{-2}$, $K_{-1}$, $K_0$, $K_{+1}$, $K_{+2}$, . . . of the keyboard are simultaneously depressed (the selected keys being identified generally as $K'_1$, $K'_2$, . . . $K'_Q$, the keys corresponding to the letter means of the highest and lowest frequencies among the keys $K'_1$, $K'_2$, . . . $K'_Q$ being identified generally as $K_H'$ and $K_L'$, respectively, the gate circuits corresponding to the keys $K_H'$ and $K_L'$ being identified generally as $G_H'$ and $G_L'$, respectively, and the sound signals supplied to the gate circuits $G_H'$ and $G_L'$ being identified generally as $S_{H+P}$ and $S_{L+P}$, respectively), the gate circuit $G_H'$ or $G_L'$ passes therethrough the sound signal $S_{H+P}$ or $S_{L+P}$ upon depression of the key $K_H'$ or $K_L'$; and wherein the frequency multiplier has a frequency multiplying ratio of the value of the ratio between a frequency defined for the letter name based on the natural scale corresponding to the letter name based on the scale of the equal temperament of 12 degrees to which a sound signal $S_M$ corresponds, and a frequency defined for the letter name based on the natural scale corresponding to the letter name based on the scale of the equal temperament of 12 degrees to which a sound signal $S_M'$ corresponds, the sound signal $S_M$ being supplied to the gate circuit of the first gate circuit means corresponding to a selected one (identified as $K_M$) of the keys . . . $K_{-2}$, $K_{-1}$, $K_0$, $K_{+1}$, $K_{+2}$, . . . of the keyboard and corresponding to the letter name based on the scale of the equal temperament of 12 degrees corresponding to the letter name based on the natural scale, and the sound signal $S_M'$ being supplied to the gate circuit of the second gate circuit means corresponding to the key $K_M$.

* * * * *

UNITED STATES PATENT AND TRADEMARK OFFICE

CERTIFICATE OF CORRECTION

PATENT NO. : 4,174,651

DATED : November 20, 1979

INVENTOR(S) : Ikutaro Kakehashi

It is certified that error appears in the above-identified patent and that said Letters Patent are hereby corrected as shown below:

Column 1, line 14 "temperature" should be -temperament-.

Column 2, line 10 "$C_4$#" should be -$C_3$#-.

Column 2, line 30 "Generally, a" should read -Generally, as-.

Column 2, line 64, remove one "S(D6')" at end of line.

Column 3, lines 12 and 13 remove one "and S(C3')".

Column 3, line 36 "K8C6)" should be -K(C6)-.

Column 4, line 1 "Th" should be -The-.

Column 4, line 17 "K(C6)" should be -K(C7)-.

Column 4, line 38 "(KC3)" should be -K(C3)-.

Column 4, line 60 "the b'" should be -the contact b'-.

Column 4, line 64 "12" should be -12"-.

UNITED STATES PATENT OFFICE
CERTIFICATE OF CORRECTION

PATENT NO. : 4,174,651
DATED : November 20, 1979
INVENTOR(S) : Ikutaro Kakehashi It is certified that error appears in the above-identified patent and that said Letters Patent are hereby corrected as shown below:

Column 5, line 24 "L"(C3)" should be -K"(C3)-.

Column 5, line 32 "15"" should be -15'-.

Column 5, line 37 "e"" should be -c"-.

Column 5, line 67 "uppr" should be -upper-.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*